United States Patent [19]

Rosenbaum et al.

[11] 3,935,548

[45] Jan. 27, 1976

[54] WIDE-BAND MICROWAVE CIRCULATOR

[75] Inventors: Fred J. Rosenbaum, Clayton, Mo.; You-Sun Wu, Richardson, Tex.

[73] Assignee: The Washington University, St. Louis, Mo.

[22] Filed: June 4, 1974

[21] Appl. No.: 476,234

[52] U.S. Cl. ..... 333/1.1; 333/24.2

[51] Int. Cl.[2] ..... H01P 1/36; H01P 1/38

[58] Field of Search ..... 333/1.1

[56] References Cited

UNITED STATES PATENTS

| | | | |
|---|---|---|---|
| 3,753,156 | 8/1973 | Miura et al. | 333/1.1 |
| 3,758,878 | 9/1973 | Wainwright | 333/1.1 |

*Primary Examiner*—Paul L. Gensler

*Attorney, Agent, or Firm*—Sughrue, Rothwell, Mion, Zinn & Macpeak

[57] ABSTRACT

A planar Y-junction microwave circulator formed by depositing on a ferrite substrate a metallization pattern consisting of a central resonant disc and three transmission line ports radially extending from the periphery of the disc at junctions spaced apart by 120°. The transmission characteristics of the circulator are controlled by a DC magnetic field which biases the ferrite. Wide-band operation on the order of one octave is achieved by using larger port coupling angles and a smaller disc radius than are conventionally used.

5 Claims, 5 Drawing Figures

WIDE-BAND MICROWAVE CIRCULATOR

The invention herein described was made in the course of or under a contract or subcontract thereunder, with the Department of the Air Force.

BACKGROUND OF THE INVENTION

1. Field of the Invention

This invention relates to the field of microwave circulators and, more particularly, to a Y-junction circulator having a unique geometry which permits wide-band operation:

2. Description of the Prior Art

Microwave circulators and, more particularly, planar geometry junction-type circulators which utilize ferrites are generally known in the prior art. One such type of prior art circulator is the Y-junction microwave integrated circuit or microstrip circulator. Such a device employs a substrate which may take the form of a solid piece of ferrite, a ferrite puck inserted in a hole within a nonmagnetic dielectric, or a ferrite layer bonded on top of a nonmagnetic dielectric.

A Y-junction metallization pattern is then deposited on top of the substrate. The pattern is in the form of three transmission lines or ports extending radially from the periphery of the center portion or resonant disc of the pattern. The three ports are angularly spaced at intervals of 120°. With such an arrangement, the center portion, or resonant disc of the metallization pattern, will cause the electromagnetic fields in the junction region to interact with the ferrite in the substrate to produce circulator action. The substrate is also metallized on its bottom side to form a ground plane and is bonded to a metal carrier by means of solder or electrically-conductive cement.

The ferrite is magnetically biased with a DC magnetic field provided by a permanent magnet. Moreover, two such magnets may be used, one above and the other below, the substrate.

In operation, the gyromagnetic properties of the biased ferrite permit microwave energy which enters one of the ports to exit at the nearest port in either the clockwise or counter-clockwise direction depending upon the polarity of the applied magnetic bias field, and energy will not exit at the remaining third port in the ideal or perfect situation. Any loss of transmitted power to the output port is termed the "insertion loss," and the measure of the leakage to the third or unused port is termed the "isolation."

Although the microwave-integrated circuit circulator just described is economical to fabricate, another form thereof is obtained by applying a second layer of ferrite or ferrite-and-dielectric over the top of the Y-junction metallization pattern, and then placing over this second layer a second ground plane. Such a device then becomes a balanced strip line junction circulator which is also generally known in the prior art.

Prior art designs of Y-junction circulators are based on the theoretical work of Bosma (H. Bosma, "On Stripline Y-Circulation at UHF," *IEEE Transactions on Microwave Theory and Techniques*, Vol. MTT-12, pp. 61–72, January, 1964), Davies and Cohen (Davies, J. B. and Cohen, P., "Theoretical Design of Symmetrical Junction Stripline Circulator," *IEEE Transactions on Microwave Theory and Techniques*, Vol. MTT-11, pp. 506-512, 1963), and Whiting (Whiting, K., "Design Data for UHF Circulator," *IEEE Transactions on Microwave Theory and Techniques*, Vol. MTT-15, pp. 195–198, 1967) for direct coupled circulators. Each of these authors developed a mathematical expression known as the Greens Function, which is solved for two conditions of perfect circulation, assuming zero insertion loss. The first condition determines the radius of the circulator resonant disc by providing the product SR of the radial propagation constant S and the resonant disc radius R. The second condition provides the substrate and disc impedance ratio at the junction for various coupling angles.

Such prior art designs required an SR product of approximately 1.84 which resulted in a relatively large resonant disc radius and a typical coupling angle on the order of 0.2 radian or, at best, a coupling angle less than 0.5 radian. As a consequence, such prior art circulators have a relatively high Q or narrow operating bandwidth, the widest available bandwidth being on the order of 30% of the center frequency of the operating frequency range.

SUMMARY OF THE INVENTION

The primary object of the invention is to provide an improved wide-band planar ferrite-loaded Y-junction circulator and a method of making the same.

Another object is to provide such an improved circulator having an operating bandwidth as large as one octave.

These objects are achieved generally by using (1) port coupling angles that are larger than conventionally used, and (2) a resonant disc radius which is smaller than conventionally used. More specifically, the coupling angle is chosen such that the required junction wave impedance ratio coincides with the intrinsic ferrite impedance ratio over a plurality of values of the ferrite anisotropic splitting function, determining therefrom the required product SR of the disc radial propagation constant S and disc radius R, and then determining the radius R.

This invention may be summarized as follows. The Greens function is used to find the electric and magnetic fields in the ferrite under the resonant disc. These fields are forced to satisfy the boundary conditions imposed by connecting three transmission lines or ports to the junction resonator. The ratio of the intensities of these fields is the input wave impedance at the junction between the input transmission line and the resonator. In order to achieve perfect circulation, i.e. one port completely isolated, a particular value of this input impedance must be obtained such that there is no reflection of electromagnetic energy from the junction toward the microwave source connected to the input line.

Since the input impedance is a function of the ferrite parameters $|k/u|$, $\epsilon_f$, $\epsilon_d$, and of the coupling angle $\psi$, calculations can be made to select the appropriate parameters in order to obtain a wide band impedance match. The results of these calculations are shown by graphs in the attached drawing.

DETAILED DESCRIPTION OF THE PREFERRED EMBODIMENT

Figure 1:
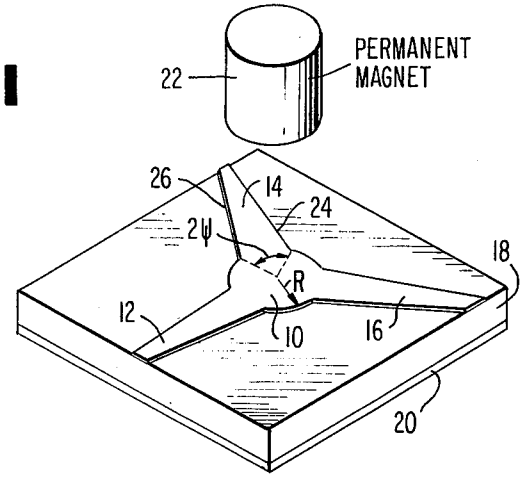
FIG. 1 is a schematic diagram of a Y-junction circulator to which the principle of this invention is applied.

In the present state of the art of designing Y-junction microstrip circulators of the type shown in FIG. 1, every designer knows that two conditions must be met before perfect non-reciprocal circulation is achieved. In FIG. 1, a metallization pattern, consisting of a conductive resonant disc 10 and transmission line ports 12, 14 and 16, are formed on a ferrite substrate 18. The metallization pattern may be formed by conventional photoetching or plasma deposition techniques, for example. A conductive ground plane 20 is formed on the bottom of the substrate. The ports are angularly spaced apart by 120°.

The first condition is that the product SR = 1.84, where S is the radial propagation constant of the waveguide formed by the resonant conductive disc 10 on the ferrite substrate 12, and R is the radius of the disc.

The second condition which must be met is one of matching the impedance of the transmission line ports to the input impedance of the junction.

These two conditions are specified by Bosma for perfect circulation, i.e. infinite isolation of one port such that all the energy entering an input port exits at a second port, and no energy exists at the third port. The output port at which the input energy exits is determined by the direction of the applied DC magnetic field which is typically applied by a permanent magnet 22.

The coupling angle $\psi$ at the junction between the periphery of the disc and each transmission line port is then defined by Bosma for small $\psi$ on the order of 0.2 radian based on a single mode only, as:

$$\sin \psi = \frac{\pi Z_d}{\sqrt{3}\,(1.84)\, Z_{eff}} \quad \frac{k}{\mu}$$

where $S = \omega/c \quad \sqrt{\mu eff \epsilon f}$ = radial propagation constant in disc R = disc radius $\omega$ = radian microwave frequency C = speed of light in vacuum $Z_d = 120\pi / \sqrt{\epsilon_d}\,\Omega$ = wave impedance in region outside resonator $Z_{eff} = 120\pi \quad \sqrt{\mu eff/\epsilon_f}\,\Omega$ = wave impedance in ferrite loaded disc $2\psi$ = angle subtended by the edges 24 and 26 of the coupled lines at the disc edge. and $\epsilon_d$, $\epsilon_f$ are the relative permittivities of the substrate below the transmission line ports and the ferrite, respectively.

By contrast, in the present invention, coupling angle $\psi$ is an adjustable parameter whose value is selected to make the frequency range, over which the required impedance match is achieved, as large as possible, thereby producing wide band circulator operation, on the order of one octave, for example.

For the embodiment shown in FIG. 1, where the disc and the transmission lines are formed on the same substrate, $\epsilon_d$ and $\epsilon_f$ are equal.

The ferrite is described by its permeability tensor elements $k$ and $u$, and $$\mu_{eff} = \frac{\mu^2 - k^2}{\mu}.$$

If the ferrite is magnetized to saturation, $k$ and $u$ are the Polder tensor elements (Polder, D., "On the Theory of Ferromagnetic Resonance," *Philosophical Magazine*, Vol. 40, pp. 99–15, January 1949).

Figure 2:
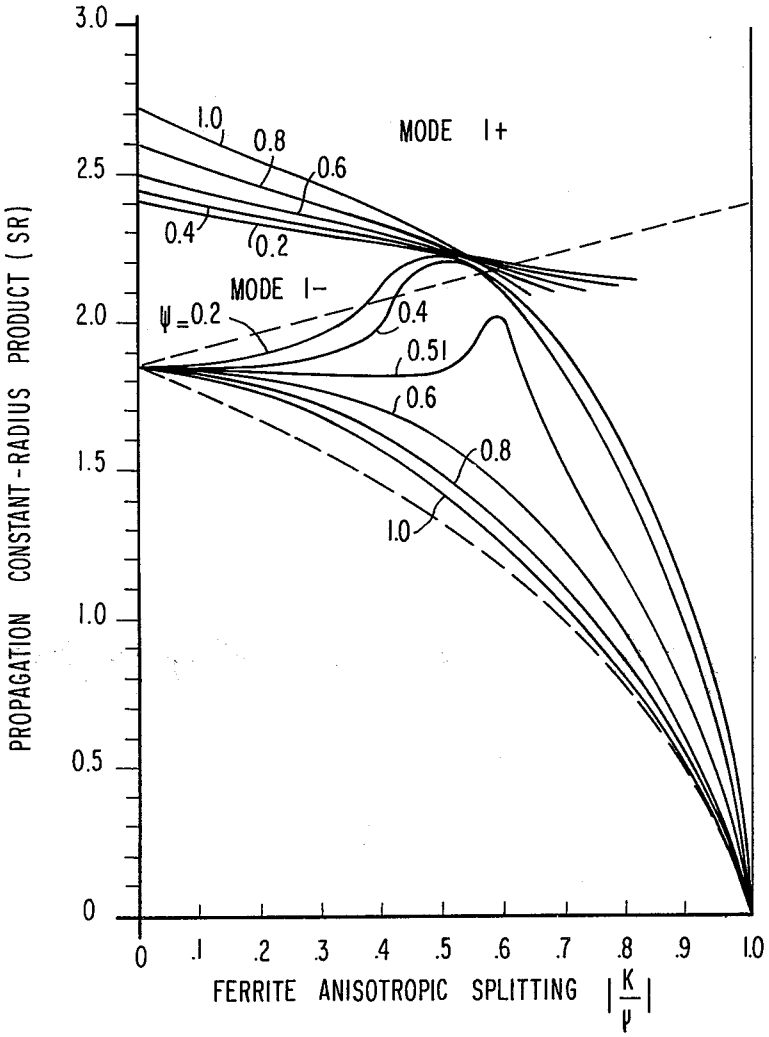
FIG. 2 is a graph of the product SR of resonant disc radial propagation constant and disc radius R vs. the ferrite anisotropic splitting factor $|k/u|$ for various coupling angles for the condition of perfect circulation.

FIG. 2 is a plot of the product of the propagation constant S and the disc radius R vs. $|k/u|$, where $|k/u|$ is termed the ferrite anisotropic splitting factor. FIG. 2 shows the dependence of SR on $|k/u|$ for several coupling angles $\psi$ and is obtained by including the first three terms in Bosma's Green's Function Expansion. These solutions are denoted by Mode 1−. The dashed lines represent the non-degenerate resonances of the uncoupled disc resonator. Another set of solutions (1+) is also shown which is seldom employed, since larger values of SR would be needed in an actual circulator.

Figure 3:
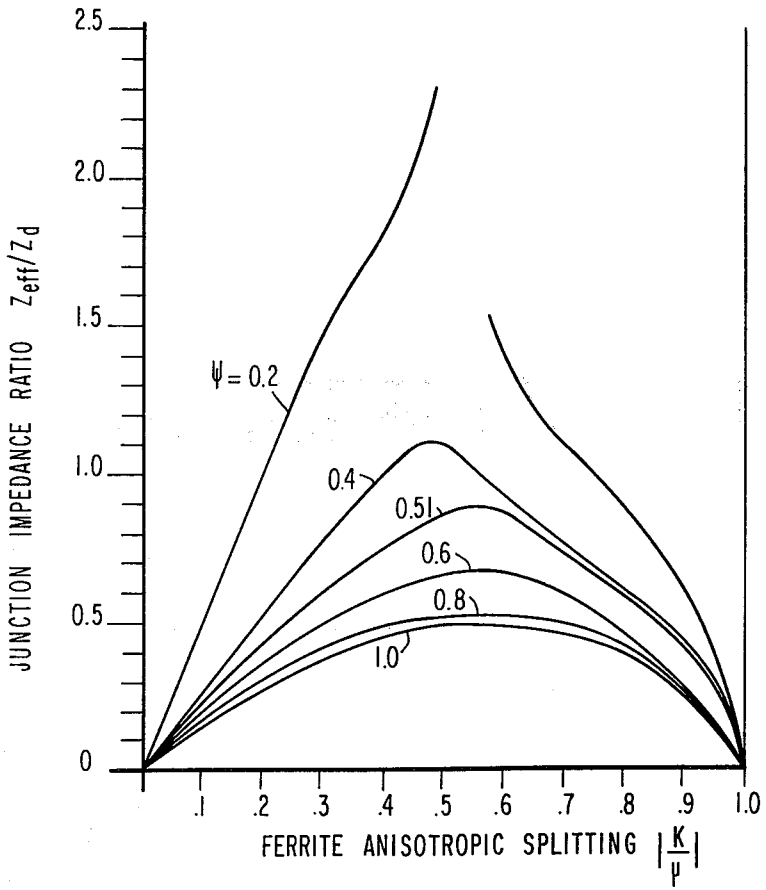
FIG. 3 is a graph of the required normalized junction wave impedance ratio as a function of $|k/u|$ for various coupling angles.

The normalized junction wave impedance $Z_{eff}/Z_d$, required for circulation at various coupling angles $\psi$, is shown as a function of $|k/u|$ in FIG. 3.

Now the intrinsic ferrite wave impedance ratio $Z'_{eff}/Z_d$ is explicitly defined as $$\frac{Z'_{eff}}{Z_d} = \sqrt{\frac{\epsilon_d}{\epsilon_f}} \left[\frac{\mu^2 - k^2}{\mu}\right]^{1/2}$$

which is approximately equal to $$\sqrt{\frac{\epsilon_d}{\epsilon_f}} \left[1 - \left(\frac{k^2}{\mu}\right)\right]^{1/2}$$

provided that $u$ does not deviate significantly from unity. The required impedance matching is achieved for $Z'_{eff} = Z_{eff}$.

Figure 4:
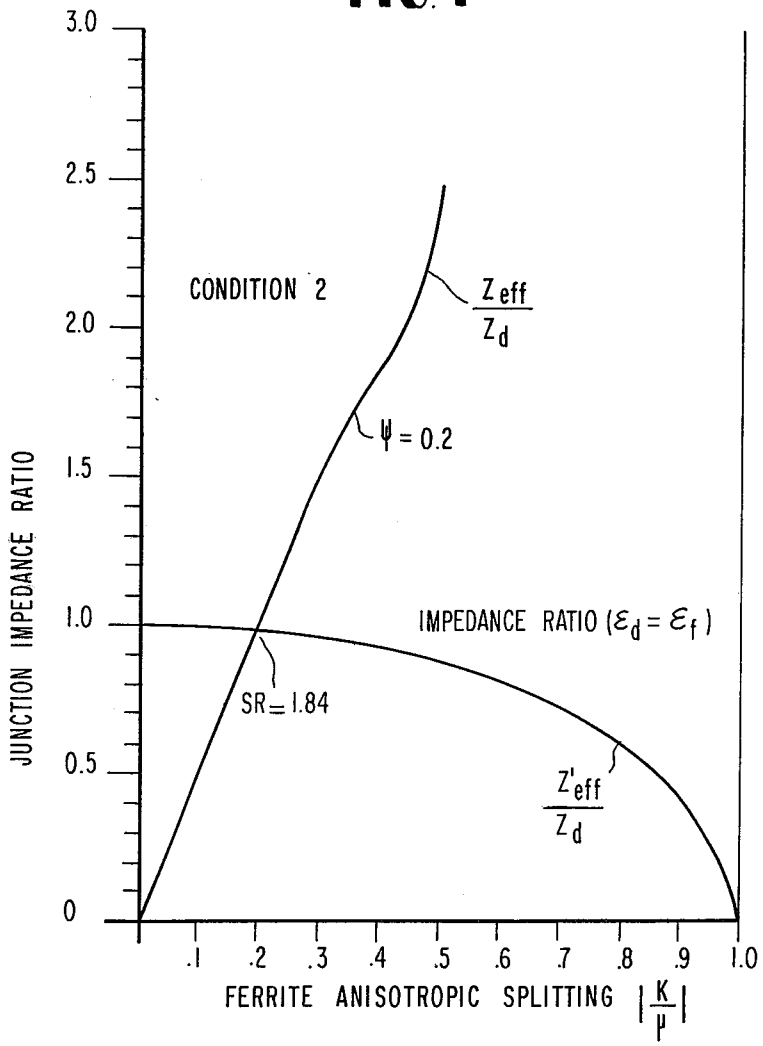
FIG. 4 is a graph comparing the normalized intrinsic ferrite impedance ratio and one curve from FIG. 3, as used in the design of a typical prior art narrow band circulator.

FIG. 4 shows this calculated intrinsic ferrite wave impedance ratio $Z'_{eff}/Z_d$ as a function of the ferrite anisotropic splitting factor $|k/u|$. Superimposed on this plot is the required junction wave impedance ratio $Z_{eff}/Z_d$ for $\psi = 0.2$ radian from FIG. 3. As can be seen from FIG. 4, the two curves intersect at $|k/u| = 0.2$, which, as can be seen from FIG. 2, calls for an SR product of approximately 1.84 and a resultant narrow bandwidth, as indicated by the relatively narrow divergence of the two dashed lines in FIG. 2. In other words, the microstrip device will function as a circulator only in a very narrow bandwidth, the largest bandwidth available in prior art devices being on the order of 30% of the center frequency of the operating range. These conditions represent a typical prior art direct coupled (and narrow band) circulator design.

In contrast, our invention provides a wideband circulator having a bandwidth on the order of one octave; that is, if the center operating frequency is 12 GHz, the lower or cutoff frequency would be 8 GHz and the upper frequency would be 16 GHz. This compares with the maximum available bandwidth in the prior art of 30%, which, for the above example, would be a bandwidth of only 3.6 GHz centered at 12 GHz.

In essence, our discovery is that, by choosing larger coupling angles and smaller resonant disc radii than those chosen in prior art designs, one can make Y-junction circulators having operating bandwidths on the order of one octave. Such wideband circulators are required for applications where a large range of frequencies are involved, such as in swept-frequency oscillators, various measuring instruments, electronic communications, and electronic warfare gear. Heretofore, such applications required costly coaxial line components. By contrast, our improved Y-junction circulator per se is capable of extremely wideband operation.

The manner in which we achieve such a desired result is best understood by reference to the curves shown in FIGS. 2–5.

First, as previously explained, the vertical separation between the dashed lines in FIG. 2 corresponds to the operating bandwidth of the circulator. For example, in the prior art devices where Bosma's design condition required the product of the resonant disc radial propagation constant S and the disc radius R to be approximately equal to 1.84, in order to obtain the required second condition of matching the transmission line ports to the intrinsic junction impedance, one was restricted to coupling angles typically on the order of 0.2 radian.

Figure 5:
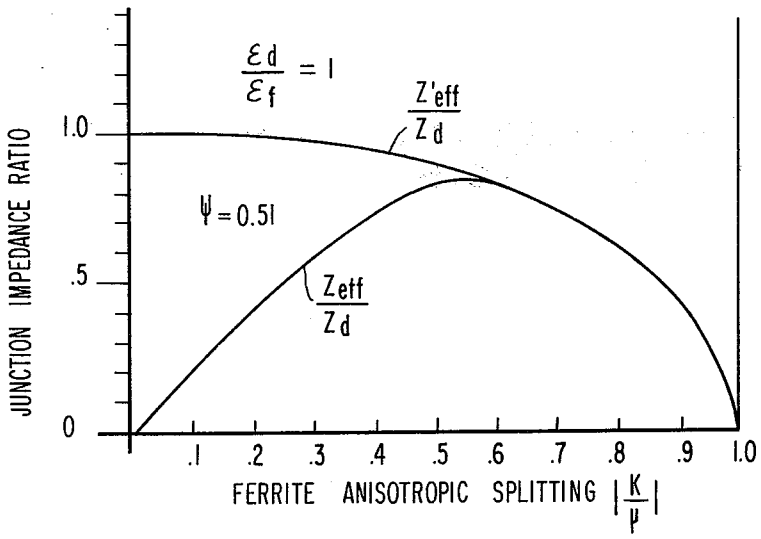
FIG. 5 is a graph comparing the normalized instrinsic ferrite impedance ratio with the required junction wave impedance ratio for a large coupling angle, thereby showing the manner in which wide-band circulator operation is obtained in accordance with our invention.

However, FIG. 3 shows that the required junction wave impedance ratio $Z_{eff}/Z_d$ curves for a ferrite anisotropic splitting factor
greater than approximately 0.5 have negative slopes, and that these negative slopes for coupling angles of greater than approximately 0.5 radian substantially coincide with the intrinsic ferrite impedance ratio curve $Z'_{eff}/Z_d$ plotted in both FIGS. 4 and 5. Again, FIG. 4 shows a typical prior art design where the required junction wave impedance ratio curve for the typical prior art coupling angle of 0.2 radian intersects the intrinsic ferrite impedance ratio curve at an anisotropic splitting factor $|k/u|$ value of approximately 0.2, which value, as seen from FIG. 2, results in very narrow bandwidth operation.

To illustrate our invention, we have shown in FIG. 5 a comparison of a plot of the intrinsic ferrite impedance ratio $Z'_{eff}/Z_d$ and the $\psi = 0.51$ curve from FIG. 3, and this comparison shows that the two curves substantially coincide for a range of anisotropic splitting factor $|k/u|$ values of from approximately 0.5 to 1.0. In other words, the two impedances coincide over a large range of common values of the anisotropic splitting function, rather than intersecting at only one point as shown in FIG. 4. In general, for the values chosen, the resulting bandwidth would be one octave, corresponding to the fact that the upper limit (1.0) of the range of coincident values of anisotropic splitting factors is twice that of the lower limit (0.5) of coincidence. It is also to be noted that, once the appropriate wide coupling angle is chosen, the two curves shown in FIG. 5 coincide for substantial lengths thereof.

In accordance with our invention, then, in order to complete the design of such a wideband circulator, one need only choose the proper radius R of the resonant disc in order to produce the desired product of S and R as required by the curves shown in FIG. 2 for various coupling angles. To be more specific, one merely chooses the ferrite anisotropic splitting factor from FIG. 5 which is in the middle of the range of coincidence of the two curves, and then finds the appropriate SR product from FIG. 2. For the example chosen, the mid-value of coincidence for the range of anisotropic splitting factors of 0.5 to 1.0 is 0.75. One then refers to FIG. 2 and finds that the SR product corresponding to anisotropic splitting factor 0.75 for a coupling angle $\psi$ of 0.51 to be approximately 1.35. Since S is known for the particular ferrite and center frequency chosen, then the required radius R is easily determined. It will be noted that values of the coupling angle which are approximately equal to 0.5 radian produce the desired coincidence, and that the resulting required values of SR average about 1.2 (from FIG. 2).

For the example plotted in FIG. 5, it was assumed that the dielectric constants of the area beneath the resonant disc and for the area beneath the transmission line ports were identical, i.e. that the ports and resonant disc were both plated on the same ferrite substrate. Of course, if only the resonant disc is placed on a corresponding ferrite plug or disc and the transmission line ports are formed on some other substrate, then these two dielectric constants will not be the same. However, if such is the case, then one merely selects a coupling angle different from 0.5 radian which will provide the required design condition. For example, as indicated by the equations presented above, if the relevant permittivities $\epsilon_d$ and $\epsilon_f$ of the outside region and the ferrite, respectively, are different rather than being the same as in the example shown in FIG. 5, and if $\epsilon_d$ is greater than $\epsilon_f$, then the required coupling angle $\psi$ will be smaller than 0.51 rad., and conversely, if $\epsilon_d$ is smaller than $\epsilon_f$, the required coupling angle $\psi$ for wideband operation on the order of one octave will be greater than 0.51 radian.

To summarize, to design a wideband circulator in accordance with our invention, one first chooses the ferrite, determines its dielectric constant, and plots the intrinsic ferrite wave impedance ratio $Z'_{eff}/Z_d$ as shown in FIG. 4. In selecting the ferrite, the saturation magnetization $4\pi M_s$ should be chosen so that 2.8 $(4\pi M_s)$ MHz is the lowest cutoff frequency, of the desired operation for the circulator.

The second step is to choose the coupling angle $\psi$ which permits the required junction impedance $Z_{eff}/Z_d$ curve to overlap the ferrite curve as shown in FIG. 5. The center frequency of operation is found from FIG. 5 in terms of the ferrite anisotropic splitting function 0f $|k/u|$. The SR product required for circulation is chosen from the curves in FIG. 2 for the selected coupling angle $\psi$ and the selected midrange value of $|k/u|$. Since the resonant disc radial propagation factor S is known, the required radius for the disc is easily determined.

As indicated above, a characteristic of our improved circulator is that the coupling angles are larger than those used in the prior art and that the resonant disc radius is smaller than that used in the prior art. For maximum bandwidth operation, the bias field provided by the permanent magnet should be chosen so as to just draw the ferrite into saturation. The transmission line ports may be connected to other devices by conventional connectors and impedance matching transformers. Furthermore, this invention contemplates both a microstrip circulator having one ground plane and one ferrite substrate and also a strip line circulator having two ground planes and one or two ferrite substrates. Moreover, either type of circulator can be converted to a microwave isolator, which permits the flow of energy in one direction only, by electrically matching the third port, thus absorbing any energy incident upon it.

In one device constructed by us, the conductive resonant disc was made of plated gold and had a radius of 0.100 inches, and the junction coupling angle was approximately 0.525 radian. The ferrite material used was a 0.025 inch × 1 inch × 1 inch substrate of TT1-390 obtained from Trans-Tech, Inc. of Gaithersburg, Maryland. This ferrite material has a saturation magnetization $4\pi M_s$ of 2,150 Gauss. The circulator was matched by a linear transformer to each of three microstrip transmission lines each having a characteristic impedance of 50 ohms and each transformer was 0.400 inch long.

While the foregoing specification describes the preferred embodiments of the invention and the best mode known to us of practicing the invention, the following claims define the scope of the invention.

We claim:

1. A method of making a wide-band Y-junction microwave circulator of the type including a ground plate associated with a ferrite substrate on which is superposed a conductive planar circular disc having three conductive transmission ports extending radially from the periphery of the disc and spaced apart by 120°, the method comprising the steps of:

a. determining as a first function the intrinsic ferrite wave impedance ratio vs. the ferrite's known anisotropic splitting factor $|k/u|$, where k and u are the ferrite's permeability tensor elements;

b. selecting and making the coupling angle of each port at its junction with the disc such that a second function, the required junction wave impedance ratio vs. $|k/u|$, coincides with said first function at a plurality of values of $|k/u|$; and c. selecting and making the radius R of the disc for the selected coupling angle such that the product of S and R has a value corresponding to a selected $|k/u|$ value within the range of the plurality of coincident $|k/u|$ values for said first and second functions, where S is the radial propagation constant of the disc.

2. The method as defined in claim 1 wherein the selected $|k/u|$ value is approximately in the middle of said range of coincident $|k/u|$ values.

3. The method as defined in claim 1 wherein said conductive transmission line ports are also superposed on said ferrite substrate, and wherein the range of coincident values of $|k/u|$ is from approximately 0.5 to 1.0, the selected coupling angle is greater than 0.5 radian, and the product of S and R is approximately 1.2.

4. The method as defined in claim 1 further comprising the step of converting the circulator to an isolator by electrically matching one port.

5. In a wide-band Y-junction microwave circulator of the type including a ground plate associated with a ferrite disc of radius R on which is superposed a resonant conductive disc of radius R, three radially extending conductive transmission line ports respectively forming three Y-junctions with the periphery of the disc and spaced apart by 120°, the edges of each port defining an arc which subtends an angle $2\psi$ where $\psi$ is defined as the coupling angle of each port with the disc, and the ferrite disc has a known radial propagation constant S; the improvement wherein said conductive disc and said ports are superposed on a common ferrite substrate, said ferrite disc is defined by the substrate portion beneath said conductive disc, and the radius R and the coupling angle $\psi$ have values such that the ratio of the wave impedance in the ferrite disc and the wave impedance in the region outside the disc substantially coincides with the intrinsic ferrite impedance ratio for a plurality of common values of the known ferrite anisotropic splitting factor $|k/u|$ where $k$ and $u$ are the ferrite's permeability tensor elements; and wherein the range of said plurality of common ferrite anisotropic splitting factor values is from approximately 0.5 to 1.0, said coupling angle is greater than 0.5 radian, and the product of S and R is approximately 1.2.

* * * * *

UNITED STATES PATENT AND TRADEMARK OFFICE

CERTIFICATE OF CORRECTION

PATENT NO. : 3,935,548

DATED : January 27, 1976

INVENTOR(S) : Fred J. ROSENBAUM et al

It is certified that error appears in the above-identified patent and that said Letters Patent are hereby corrected as shown below:

Column 3, line 47, delete " $\sin\psi = \frac{\pi Z_d}{\sqrt{3}\,(1.84)\,Z_{eff}} \frac{\kappa}{\mu}$ " and insert-- $\sin\psi = \frac{\pi Z_d}{\sqrt{3}\,(1.84)\,Z_{eff}}\left(-\frac{\kappa}{\mu}\right)$ -- line 51, delete " $\sqrt{\mu eff \varepsilon f}$ " and insert-- $\sqrt{\mu_{eff}\varepsilon_f}$ -- line 55, delete "$120\pi/\sqrt{\varepsilon_d}\,\Omega$ " and insert-- $120\pi/\sqrt{\varepsilon_d}\,\Omega$ -- line 57, delete " $\sqrt{\mu eff/\varepsilon_f}\,\Omega$ " and insert-- $\sqrt{\mu_{eff}/\varepsilon_f}\,\Omega$ --

Column 6, line 40, delete the comma after "frequency"

line 46, delete "Of" and insert-- of --

Signed and Sealed this

*twenty-second* Day of *June 1976*

[SEAL]

*Attest:*

RUTH C. MASON
*Attesting Officer*

C. MARSHALL DANN
*Commissioner of Patents and Trademarks*